US005168545A

United States Patent [19]

Hart

[11] Patent Number: 5,168,545

[45] Date of Patent: Dec. 1, 1992

[54] TEMPERATURE OPERATED CONTROL SYSTEM, CONTROL DEVICE THEREFOR, AND METHODS OF MAKING THE SAME

[75] Inventor: Lee A. Hart, Holland, Mich.

[73] Assignee: Robertshaw Controls Company, Richmond, Va.

[21] Appl. No.: 848,304

[22] Filed: Mar. 9, 1992

Related U.S. Application Data

[63] Continuation of Ser. No. 654,508, Feb. 13, 1991, abandoned.

[51] Int. Cl.[5] ..... F24H 1/20; H01H 37/58

[52] U.S. Cl. ..... 392/449; 335/208

[58] Field of Search ..... 219/449, 495, 515; 335/146, 208; 392/441, 449, 450–454

[56] References Cited

U.S. PATENT DOCUMENTS

| | | | |
|---|---|---|---|
| 2,498,683 | 2/1950 | Hubbell | 335/205 |
| 3,559,124 | 1/1971 | Posey | 335/205 |
| 3,760,312 | 9/1973 | Shlesinger, Jr. | 335/205 |
| 3,889,215 | 6/1975 | Yoshino et al. | 335/202 |
| 3,895,328 | 7/1975 | Kato et al. | 335/208 |
| 3,903,492 | 9/1975 | Endo et al. | 335/208 |
| 3,974,469 | 8/1976 | Nicholls | 335/205 |
| 4,004,259 | 1/1977 | Krause | 335/208 |
| 4,325,042 | 4/1982 | Endo et al. | 335/208 |
| 4,419,644 | 12/1983 | Baermann | 335/288 |
| 4,610,142 | 9/1986 | Davis | 219/495 |
| 4,944,083 | 7/1990 | McIntosh | 29/622 |

*Primary Examiner*—Bruce A. Reynolds
*Assistant Examiner*—John A. Jeffery
*Attorney, Agent, or Firm*—Candor, Candor & Tassone

[57] ABSTRACT

A temperature operated control system, a temperature operated control device therefor and methods of making the same are provided, the temperature operated control device comprising a support, an electrical reed switch unit carried by the support, the reed switch unit comprising a reed switch and a temperature controlled fixed magnetic unit for causing the reed switch to be in a first operating condition thereof when the temperature sensed by the magnetic unit is at or below a first temperature setting and for causing the reed switch to be in a second operating condition thereof when the temperature sensed by the magnetic unit is at or above a second temperature setting, and a selector unit movably carried by the support and being operatively associated with the reed switch unit to adjust the temperature settings thereof within a certain range of temperature settings as the selector unit is moved relative to the reed switch unit.

2 Claims, 2 Drawing Sheets

TEMPERATURE OPERATED CONTROL SYSTEM, CONTROL DEVICE THEREFOR, AND METHODS OF MAKING THE SAME

CROSS REFERENCE TO RELATED APPLICATION

This application is a continuation patent application of its copending parent patent application Ser. No. 654,508, filed Feb. 13, 1991, now abandoned.

BACKGROUND OF THE INVENTION

1. Field of the Invention

This invention relates to a new temperature operated control system and to a new temperature operated control device for such a system or the like as well as to new methods of making such a system and such a control device.

2. Prior Art Statement

It is known to provide a temperature operated control device comprising a support means, and an electrical reed switch means carried by the support means, the reed switch means comprising a reed switch and a temperature controlled fixed magnetic means for causing the reed switch to be in a first operating condition thereof when the temperature sensed by the magnetic means is at or below a first temperature setting and for causing the reed switch to be in a second operating condition thereof when the temperature sensed by the magnetic means is at or above a second temperature setting. For example, see FIGS. 3 and 4 of the drawings of this patent application.

It is also known that manufacturers of such temperature operated reed switch means have published literature which warns users of their electrically operated reed switch means that various external devices disposed in the vicinity of the reed switch means can influence the temperature settings of the switching of such electrical reed switch means, such known external influencing means including permanent magnets.

However, applicant is unaware of any attempt to provide a selector means that has such external influencing means for the purpose of selectively adjusting the temperature settings of the temperature operated electrical reed switch means.

SUMMARY OF THE INVENTION

It is one of the features of this invention to provide a new temperature operated control device wherein the temperature settings of a conventional temperature operated electrical reed switch means can be adjusted by an operator.

In particular, it is believed according to the teachings of this invention that a selector means can be operatively associated with the temperature operated reed switch means to adjust the temperature settings thereof within a certain range of temperature settings as the selector means is moved relative to the reed switch means.

It is believed that such selector means can comprise a fixed magnet that will influence the magnetic field that is produced by a temperature controlled fixed magnetic means of the electrical reed switch means so as to alter the temperature at which the reed switch switches.

For example, one embodiment of this invention comprises a temperature operated control device comprising a support means, an electrical reed switch means carried by the support means, the reed switch means comprising a reed switch and a temperature controlled fixed magnetic means for causing the reed switch to be in a first operating condition thereof when the temperature sensed by the magnetic means is at or below a first temperature setting and for causing the reed switch to be in a second operating condition thereof when the temperature sensed by the magnetic means is at or above a second temperature setting, and a selector means movably carried by the support means and being operatively associated with the reed switch means to adjust the temperature settings thereof within a certain range of temperature settings as the selector means is moved relative to the reed switch means.

It is another feature of this invention to provide such a control device for operating the control system for a domestic or commercial water heater tank or the like.

Accordingly, it is an object of this invention to provide a new temperature operated control device having one or more of the novel features of this invention as set forth above or hereinafter shown or described.

Another object of this invention is to provide a new method of making such a temperature operated control device, the method of this invention having one or more of the novel features of this invention as set forth above or hereinafter shown or described.

Another object of this invention is to provide a new temperature operated control system having one or more of the novel features of this invention as set forth above or hereinafter shown or described.

Another object of this invention is to provide a new method of making such a temperature operated control system, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
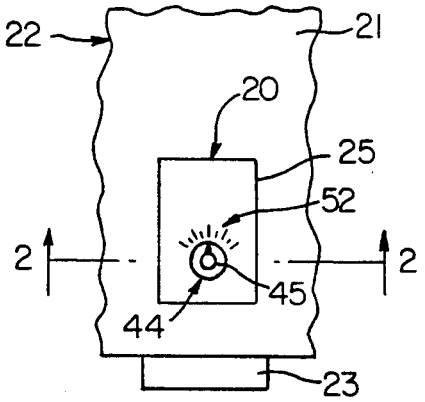
FIG. 1 is a fragmentary front view of an electrically operated water heater tank carrying the new temperature operated control device of this invention and utilizing the new temperature operated control system of this invention that is illustrated in FIG. 6.

While the various features of this invention are hereinafter illustrated and described as being particularly adapted to provide a temperature operated control system and a temperature operated control device for controlling the operation of an electrically operated water heater tank, it is to be understood that the various features of this invention can be utilized singly or in various combinations thereof to provide a temperature operated control system and a temperature operated control device for operating other types of apparatus as desired.

Therefore, this invention is not to be limited to only the embodiments illustrated in the drawings, because the drawings are merely utilized to illustrate one of the wide variety of uses of this invention.

Figure 2:
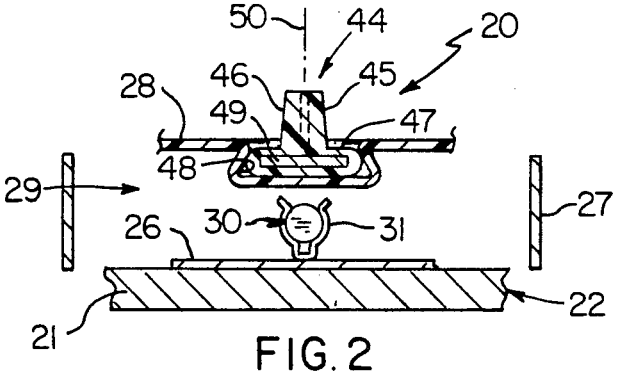
FIG. 2 is an enlarged fragmentary cross-sectional view taken on line 2—2 of FIG. 1.

Referring now to FIGS. 1 and 2, the new temperature operated control device of this invention is generally indicated by the reference numeral 20 and is illustrated as being mounted to a wall 21 of an electrically operated water heater tank that is generally indicated by the reference numeral 22 and having an electrically operated heater means 23 for heating the water contained in the tank 22 under the control of the control device 20 of this invention in a manner hereinafter set forth, the control device 20 of this invention being part of the new temperature operated control system of this invention that is generally indicated by the reference numeral 24 in FIG. 6 and hereinafter described.

The control device 20 comprises a support means or housing means 25 that comprises a bottom metallic plate means 26, sidewall means 27 formed of any suitable material and a cover member 28 also formed of any suitable material, the parts 26, 27 and 28 being suitably interconnected together to define a chamber 29 within the support means or housing means 25.

The support means or housing means 25 is adapted to be disposed against the wall 21 of the tank 22 in a manner well known in the art so that the rear plate 26 is adjacent the wall 21 in the manner illustrated in FIG. 2 so as to sense the temperature of the wall 21 and, thus, the temperature of the water in the tank 22 also in a manner well known in the art. For example, see the U.S. Pat. No. 4,944,083 to McIntosh, whereby this U.S. patent is being incorporated into this disclosure by this reference thereto.

The conventional electrically operated control device for controlling the electrically operated heater means 23 for a water heater tank 22, such as set forth in the aforementioned U.S. Pat. No. 4,944,083 to McIntosh, has a temperature operated snap disc arrangement for controlling an electrical switch means therein that will interconnect an electrical power source to the electrically operated heater means 23 when the temperature sensed by the control device is at or below a first temperature setting of the control device and will terminate the interconnection between the electrical power source and the electrically operated heater means 23 when the temperature being sensed is at or above a second temperature setting of the control device, the temperature settings both being set by a single selector means.

Figure 5:
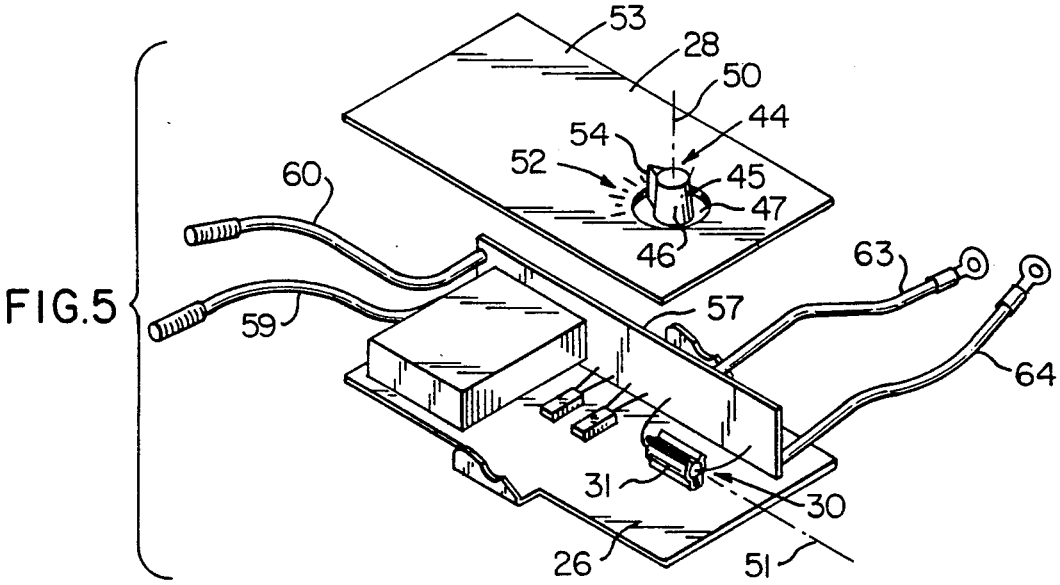
FIG. 5 is an exploded perspective view of certain parts of the control device of this invention.

The control device 20 of this invention functions in a similar manner except that instead of using a conventional temperature operated snap disc arrangement, the control device 20 uniquely utilizes a temperature operated electrical reed switch means that is generally indicated by the reference numeral 30 in FIGS. 2 and 5 and being carried by a conventional clip means 31 mounted to the rear plate 26 of the housing means 25.

Figure 3:
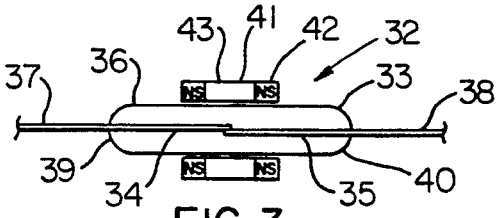
FIG. 3 PRIOR ART
FIG. 3 is a schematic view, partially in cross section, and illustrating a prior known temperature operated electrical reed switch means that can be utilized in the control device of this invention, FIG. 3 illustrating the reed switch means in the contact closed condition thereof.
Figure 4:
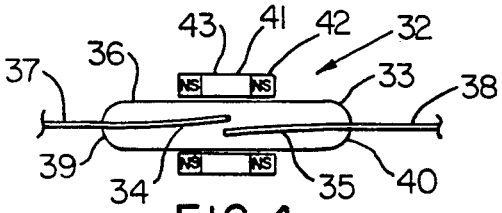
FIG. 4 PRIOR ART
FIG. 4 is a view similar to FIG. 3 and illustrates the contacts of the reed switch means in the open condition thereof.

The reed switch means 30 can be of the conventional type that is schematically illustrated in FIGS. 3 and 4 and comprising an electrical reed switch means 32 that comprises a reed switch 33 having a pair of contact means 34 and 35 encased within a glass tube 36 with the contact means 34 and 35 respectively having terminal means 37 and 38 extending out of the opposed ends 39 and 40 of the glass tube 36 whereby the contact means 34 and 35 are sealed within the glass tube 36.

The reed switch means 32 also comprises a temperature controlled fixed magnetic means 41 that is fixed around the glass tube 36 as illustrated in FIGS. 3 and 4 and comprising fixed ferrite magnets 42 with temperature responsive ferrite material 43 disposed therebetween whereby the magnetic field produced by the magnetic means 41 will maintain the contacts 34 and 35 in the closed condition of FIG. 3 as long as the temperature being sensed by the magnetic means 41 is at or below a first temperature setting of the magnetic means 41 so that an electrical current can flow through the closed switch means 32. However, when the temperature being sensed by the magnetic means 41 is at or above a second temperature setting of the magnetic means 41, the magnetic field being produced by the magnetic means 41 operates in such a manner that the same causes the contact means 34 and 35 to be in the open condition as illustrated in FIG. 4 whereby electrical current cannot flow through the reed switch means 32. Thus, the magnetic means 41 will maintain the contact means 34 and 35 in the open condition illustrated in FIG. 4 until the magnetic means 41 senses a temperature that is at or below the first temperature setting of the magnetic means 41 whereby the magnetic field thereof causes the contact means 34 and 35 to close.

While normally there is a temperature differential between the first temperature setting of the magnetic means 41 that closes the contact means 34 and 35 and the second temperature setting of the magnetic means 41 that opens the contact means 34 and 35, such temperature differential being a few degrees Fahrenheit, it may be found that some temperature operated reed switch means switch both open and closed at the same temperature setting whereby the first temperature setting and the second temperature setting would be the same.

Nevertheless, it is well known that the temperature settings of a temperature operated reed switch means can be selected through the selection of the fixed magnet means 42, the temperature responsive ferrite material 43, the position of the parts 42 and 43 relative to each other and relative to the contact means 34 and 35 all in a manner well known in the art.

It is also well known in the art that a reed switch means can normally be in an open condition thereof as long as the temperature being sensed by the magnet means thereof is at or below a first temperature setting of the magnet means and will close when the temperature being sensed by the magnet means is at or above a second temperature setting of the magnet means.

Thus, it is contemplated that the temperature operated reed switch means 30 of this invention can be of either the normally open or the normally closed type as desired.

However, in the embodiment of the control device 20 and the control system 24 of this invention, the reed switch means 30 is of the type illustrated in FIGS. 3 and 4 wherein the contact means 34 and 35 thereof are normally in the closed condition thereof and open on temperature rise.

As previously stated, it is known that outside magnetic field creating devices will influence the temperature setting of a temperature operated electrical reed switch means and it is a feature of this invention to utilize such relationship to provide a selector means that can selectively adjust the temperature settings of a temperature operated electrical reed switch means.

In particular, the selector means for the control device 20 of this invention is generally indicated by the reference numeral 44 and comprises a rotatable selector knob 45 having a grasping portion 46 and a circular disc-like portion 47 with the disc-like portion 47 being snap-fittingly disposed in a circular recess 48 in the cover 28 so as to be rotatably mounted in such recess 48. The selector means 44 carries a fixed magnet 49 in the bar-shape form as illustrated in the drawings and is encased in the material that forms the selector knob 45. For example, the selector knob 45 can be made out of any suitable material, such as plastic material, that will not shield the magnetic field that is produced by the magnet 49 and the cover member 28 is likewise formed out of any suitable material, such as plastic material, which will not shield the magnetic field of the magnet 49 as the magnetic field of the magnet 49 is to influence the magnetic field of the magnetic means 41 of the reed switch means 40 in a manner hereinafter set forth.

The undercut recess 48 in the cover 28 of the control device 20 is so arranged that the rotational axis 50 of the selector knob 45 in the recess 48 is disposed substantially perpendicular to the longitudinal axis 51 of the reed switch means 30.

However, it is to be understood that the rotational axis 50 of the selector knob 45 could be disposed at a position other than perpendicular to the longitudinal axis 51 of the reed switch means as it may be found that the influence of the magnetic field of the magnet 49 will perform in a more appropriate manner in another rotational position relative to the reed switch means 30.

Nevertheless, it is believed according to the teachings of this invention that rotation of the magnet 49 to a new rotational position relative to the reed switch means 30 will change the settings of operation of the reed switch means 30 through the influence of the magnetic field of the fixed magnet 49 on the fixed magnetic field of the magnetic means 41 of the reed switch means 30 so that through properly spacing the magnet 49 relative to the reed switch means 30 and through the selection of the size of the magnet 49 and the strength of the magnet 49, the control device 20 can be utilized to select any one of a desired temperature of operation of the control device 20 out of an appropriate range of temperatures that would be suitable for operating the heating means 23 of the water heater tank 22.

For example, it may be found that rotation of the knob 45 to a low temperature setting position thereof, such as a transverse position of the magnet 49 relative to the reed switch means 30, will set the operating temperatures of the reed switch means 30 at approximately 100° F. whereas a high temperature setting of the selector knob 45, such as a parallel position of the magnet 49 relative to the reed switch means 30, will set the operating temperatures of the reed switch means 30 at approximately 165° F. In this manner, temperatures between 100° F. and 165° F. can be selected by positioning the magnet 49 in between a true transverse and a true parallel position relative to the reed switch means 30.

Accordingly, a suitable temperature scale 52 can be provided on the top surface 53 of the cover 28 in the manner illustrated in FIG. 5 and the selector knob 45 can have a suitable pointer means 54 for positioning relative to the scale 52 to provide a means for the operator to select the temperature settings of the control device 20 through rotation of the selector knob 45 in a manner conventional for electrical water heater controls, except that in this invention, the operator is not adjusting a range spring of a snap disc arrangement as set forth in the aforementioned U.S. Pat. No. 4,944,083 to McIntosh, but is merely positioning a bar magnet 49 relative to a temperature operated electrical reed switch means 30 to cause the temperature settings thereof to be changed to desired temperature settings thereof within a certain range of temperature settings for the control device 20.

Thus, it is believed that by selecting a temperature operated reed switch means 30 that would normally have operating temperatures around 130° F., a selector means 45 with its magnet 49 could be so constructed and arranged that the same will cause such a reed switch means 30 to operate around 100° F. when the selector knob 45 is set at a low setting thereof and to cause the reed switch means 30 to operate around 165° F. when the selector knob 45 is set at a high temperature setting thereof. Of course, it may be found that other relationships might be provided for different reed switches and different bar magnets of the fixed or permanent type.

Figure 6:
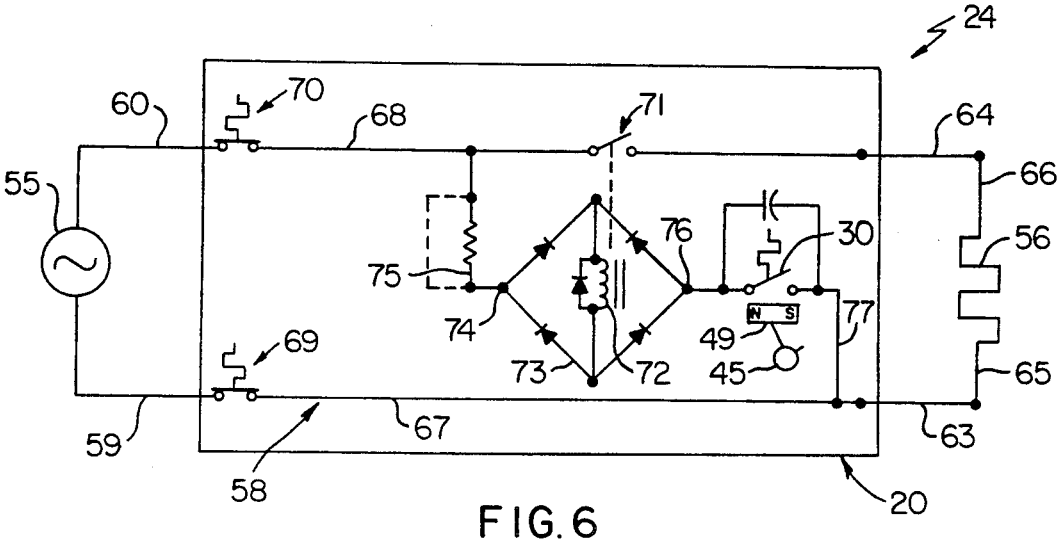
FIG. 6 is a schematic view illustrating the new temperature operated control system of this invention that can be utilized for operating the electrically operated water heater tank of FIGS. 1 and 2.

While the control device 20 and, thus, the control system 24 of this invention can have any suitable electrical circuit means for coupling an electrical power source 55 to an electrical heating element 56 of the electrical heating means 23, one such electrical circuit means of this invention is schematically illustrated in FIGS. 5 and 6 wherein it can be seen that the control device 20 has an electrical circuit board 57 provided with an electrical circuit means thereon that is generally indicated by the reference numeral 58 in FIG. 6 and having a pair of inlet leads 59 and 60 for interconnecting to opposite sides 61 and 62 of the electrical power source 55 which can comprise a conventional alternating current source of 120 volts or 220 volts as the case may be. The circuit means 58 has a pair of outlet leads 63 and 64 respectively interconnected to opposed sides 65 and 66 of the electrical heater means 56 as illustrated in FIG. 6.

The leads 59 and 60 for the power source 55 are respectively interconnected to electrical lines 67 and 68 of the electrical circuit means 58 by protective fuse means 69 and 70 while the lines 67 and 68 are respectively interconnected to the output leads 63 and 64 as illustrated in FIG. 6.

The lead 68 has a relay operated switch 71 disposed therein which will be closed when a relay coil 72 of the circuit means 58 is energized by a diode bridge 73 which has one point or corner 74 electrically interconnected to the lead 68 by a lead 75 while another point or corner 76 of the diode bridge 73 is electrically interconnected to the lead 67 by a lead 77 that has the reed switch means 30 therein that is controlled by the magnet 49 of the selector knob 45 as schematically illustrated in FIG. 6.

Thus, it can be seen that the temperature operated control system 24 will only interconnect the power source 55 to the electrical heater means 56 to operate the electrical heater means 56 when the reed switch means 30 is in a closed condition so as to interconnect the lead 67 to the point 76 of the diode bridge 73 which will thereby cause the relay coil 72 to be energized and close the relay switch 71 so that the electrical power source 55 will be connected across the electrical heater element 56 to operate the same. However, when the reed switch means 30 is in the open condition as illustrated in FIG. 6, the relay coil 72 cannot be energized whereby the relay contacts 71 are in an open condition so that the power source 55 cannot be interconnected to the electrical heater element 56.

Therefore, by adjusting the control knob 45 to the desired temperature setting on the scale means 52 of the control device 20, the reed switch means 30 will only close when the same senses a temperature at or below a first adjusted temperature setting of the reed switch means 30 and will cause the reed switch means 30 to open when the reed switch means 30 is sensing a temperature at or above a second adjusted temperature setting of the reed switch means 30 for the reasons previously set forth.

Thus, it can be seen that by setting the selector knob 45 at a desired temperature setting, such as 125° F., the reed switch means 30 will only close when the same is sensing a temperature at approximately 125° F. or below so as to cause the power source 55 to operate the heating element 56 to heat the water in the tank 22 and when the reed switch means 30 senses a temperature at approximately 125° F. or above, the reed switch means 30 will open and terminate the operation of the electrical heater means 56.

In this manner, it is believed that the control device 20 and control system 24 of this invention will readily control the operation of the water heater tank 22 in the manner previously set forth.

While the system 24 of this invention has a relay operated switch means 71 therein, it is to be understood that the system of this invention could utilize an all solid state switching arrangement if desired.

Figure 7:
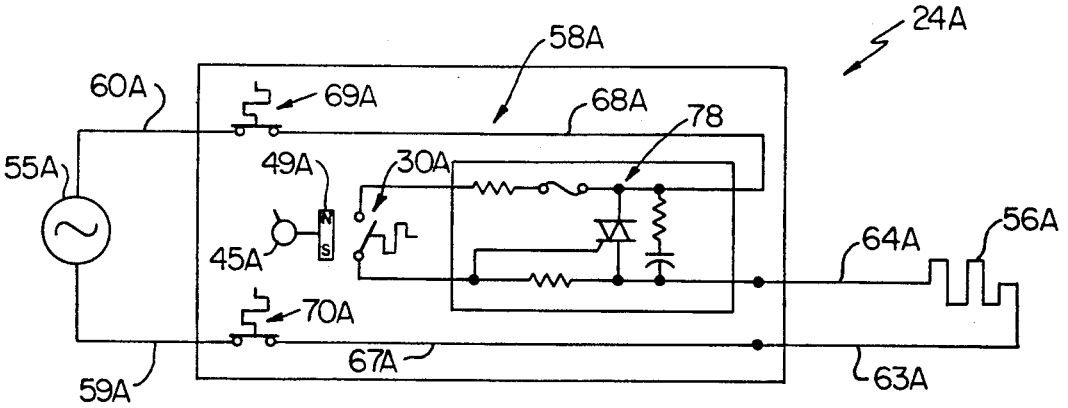
FIG. 7 is another schematic view of a temperature operated control system of this invention that can be utilized for operating the electrically operated water heater tank of FIGS. 1 and 2.

For example, another temperature operated control system of this invention is generally indicated by the reference number 24A in FIG. 7 and parts thereof similar to the system 24 previously described are indicated by like reference numerals followed by the reference letter "A".

As illustrated in FIG. 7, the system 24A includes the electrical heater means 56A interconnected to the output leads 64A and 63A while the electrical power source 55A is interconnected to the input leads 59A and 60A. The electrical circuit 58A of the control device 20A includes the fuses 69A and 70A and the leads 67A and 68A which are respectively interconnected to the output leads 63A and 64A except that the lead 68A has an electronic switching means 78 therein which is controlled by the reed switch means 30A which has its temperature setting controlled by the magnet 49A of the selector knob 45A.

Thus, it can be seen that the electronic switch means 78 cannot interconnect the lead 68A with the output lead 64A unless the temperature operated reed switch means 30A is in a closed condition thereof whereby the power source 55A can only be effectively interconnected across the heater element 56A by the circuit means 58A only when the reed switch means 30A is in a closed condition thereof. Of course, the reed switch means 30A will only be in a closed condition thereof when the same is sensing a temperature at or below a first adjusted temperature setting as selected by the selector knob 45A in the manner previously set forth. The reed switch means 30A will disconnect the electrical power source 55A from the heater element 56A when the reed switch means 30A is sensing a temperature at or above a second adjusted temperature as selected by the selector knob 45A in the manner previously set forth.

Therefore, it can be seen that this invention not only provides a new temperature operated control system and a new temperature operated control device therefor, but also this invention provides new methods of making such a new temperature operated control system and such a new temperature operated control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a temperature operated control device comprising a support means, and an electrical reed switch means carried by said support means, said support means comprising a housing means containing said reed switch means therein, said housing means having a cover means provided with an external surface means, said reed switch means comprising a reed switch and a temperature controlled fixed magnetic means for causing said reed switch to be in a first operating condition thereof when the temperature sensed by said magnetic means is at or below a first temperature setting and for causing said reed switch to be in a second operating condition thereof when the temperature sensed by said magnetic means is at or above a second temperature setting, said control device comprising a selector means movably carried by said support means and being operatively associated with said reed switch means to adjust said temperature settings thereof within a certain range of temperature settings as said selector means is moved relative to said reed switch means, said selector means comprising a fixed magnet rotatably carried by said support means, the improvement wherein said cover means and said selector means have mounting means rotatably mounting said selector means to only said external surface means of said cover means whereby said housing means seals said selector means from said reed switch means, said mounting means of said cover means comprising a circular dove-tailed recess means in said external surface means thereof and said mounting means of said selector means comprising a circular disc-like portion thereof snap-fitted into said circular dove-tailed recess means, said selector means having a knob-like portion extending out of said dove-tailed recess means to permit rotation of said selector means.

2. A control device as set forth in claim 1 wherein said control device comprises a water heater control device.

* * * * *